United States Patent [19]

Seppanen

[11] 4,306,934

[45] Dec. 22, 1981

[54] METHOD AND APPARATUS FOR FORMING PAPER

[76] Inventor: Erkki O. Seppanen, 11104 NE. 29th, Vancouver, Wash. 98665

[21] Appl. No.: 115,070

[22] Filed: Jan. 24, 1980

Related U.S. Application Data

[63] Continuation of Ser. No. 963,974, Nov. 27, 1978, Pat. No. 4,243,482.

[51] Int. Cl.[3] ..... D21F 1/20; D21F 1/40; D21F 1/50; D21F 2/00

[52] U.S. Cl. ..... 162/209; 162/211; 162/217; 162/300; 162/307; 162/314; 162/351; 162/356; 162/373

[58] Field of Search ..... 162/209, 203, 217, 256, 162/300, 307, 308, 314, 351, 356, 364, 373, 354, 202, 211

[56] References Cited

U.S. PATENT DOCUMENTS

| | | | |
|---|---|---|---|
| 1,957,963 | 5/1934 | Johnstone | 162/354 |
| 2,092,798 | 9/1937 | Charlton | 162/356 |
| 2,095,378 | 10/1937 | Charlton | 162/356 |
| 3,066,068 | 11/1962 | Calehuff et al. | 162/217 |
| 3,357,881 | 12/1967 | Bennett | 162/356 |
| 3,595,746 | 7/1971 | Little | 162/217 |
| 3,746,613 | 7/1973 | Vauhkonen | 162/203 X |
| 3,874,998 | 4/1975 | Johnson | 162/209 X |

FOREIGN PATENT DOCUMENTS

| | | | |
|---|---|---|---|
| 187711 | 7/1907 | Fed. Rep. of Germany | 162/356 |

*Primary Examiner*—Richard V. Fisher
*Attorney, Agent, or Firm*—Steinberg and Raskin

[57] ABSTRACT

The wet end of a fourdrinier paper machine includes a transversely disposed roll beneath the wire. The roll is shaped and mounted for rotation at a speed which is different from the speed of the wire to create pulses of negative pressure beneath the wire for drawing liquid from the web of fibers formed thereon. Also disclosed is a fin apparatus transversely disposed beneath the wire to create a wave of positive pressure thereunder to urge the formed web off of the wire.

16 Claims, 19 Drawing Figures

FIG. 1
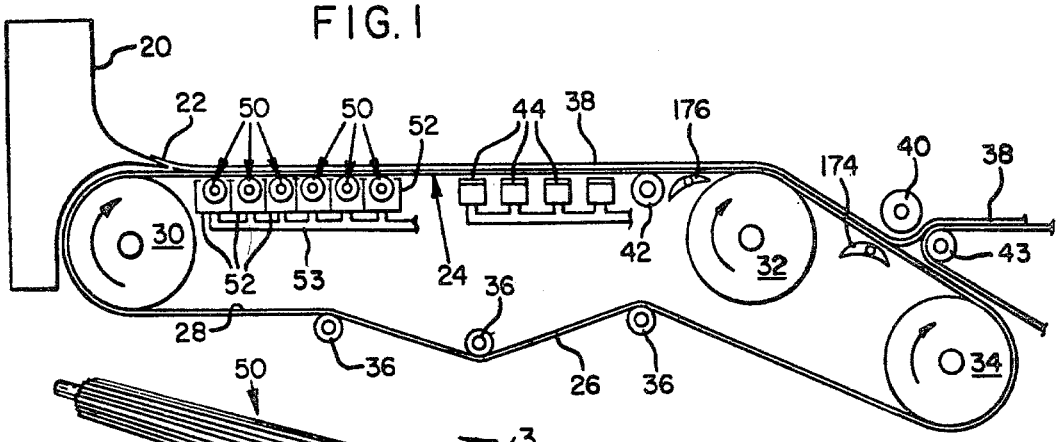
FIG. 2
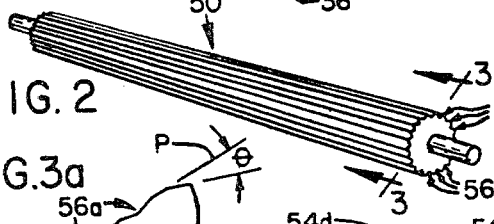
FIG. 3a
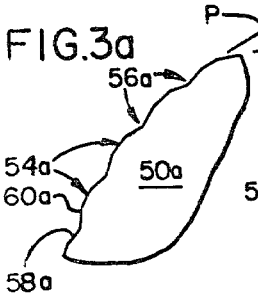
FIG. 3b
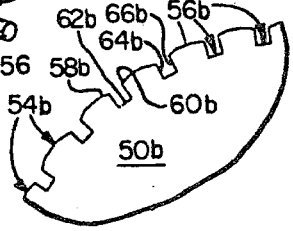
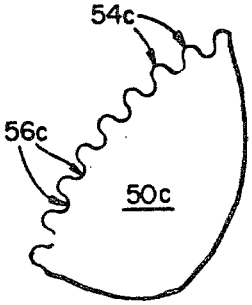
FIG. 3c
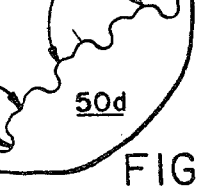
FIG. 3d
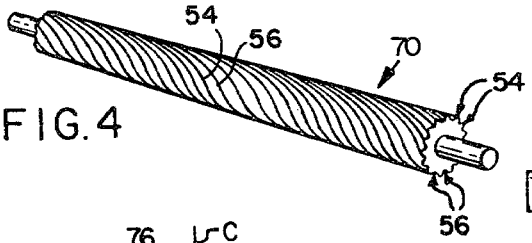
FIG. 4
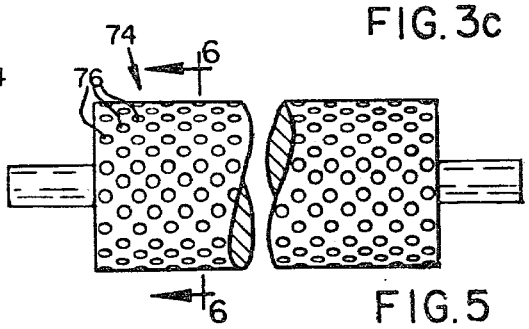
FIG. 5
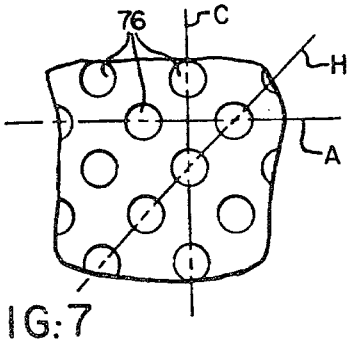
FIG. 7
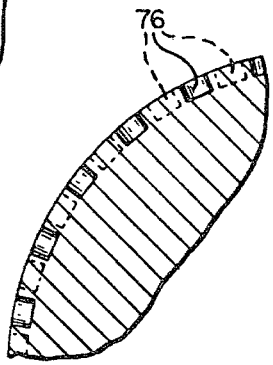
FIG. 6
FIG. 8
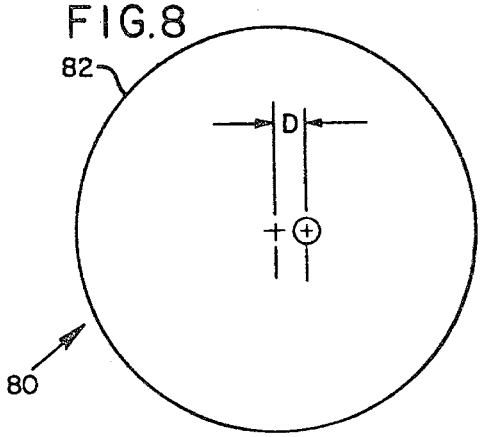

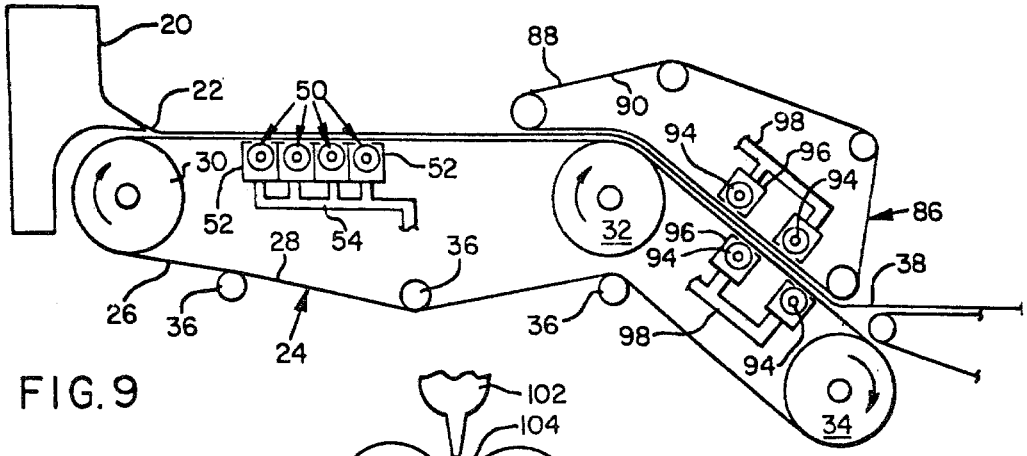
FIG. 9
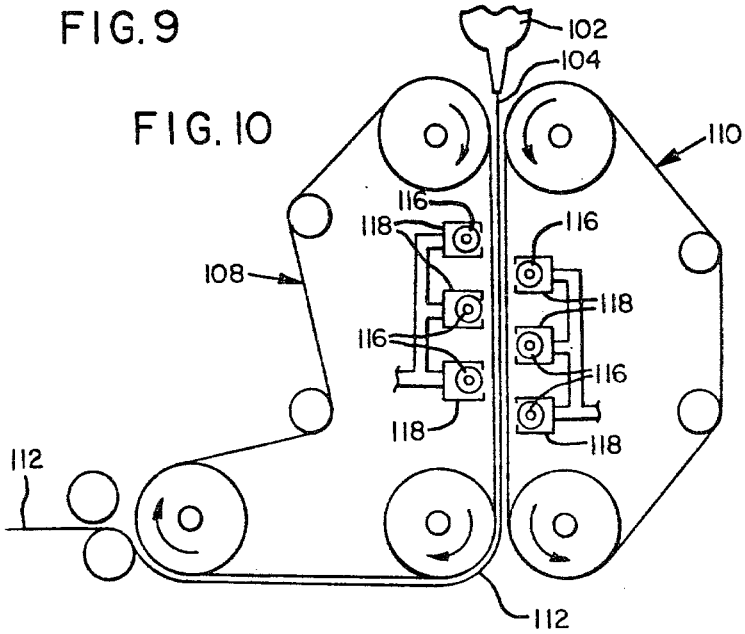
FIG. 10
FIG. 11
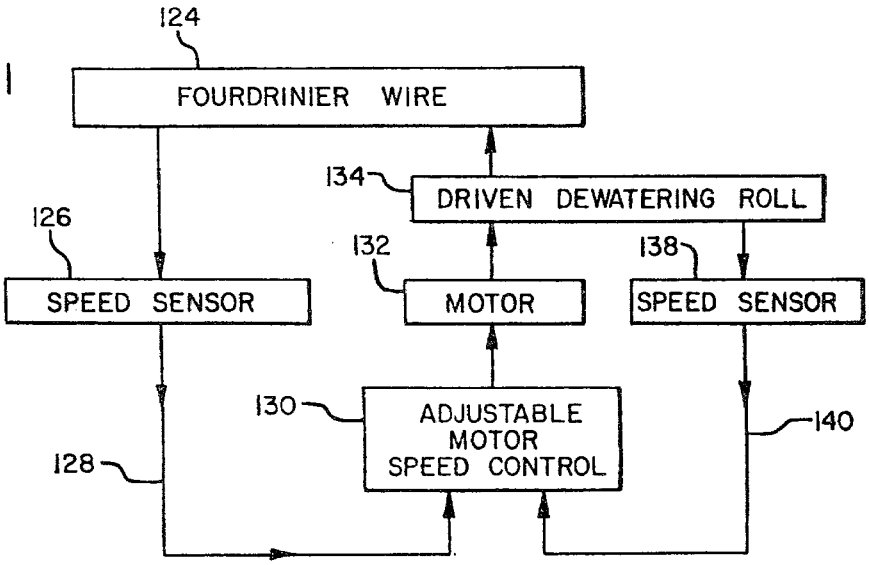

FIG. 12
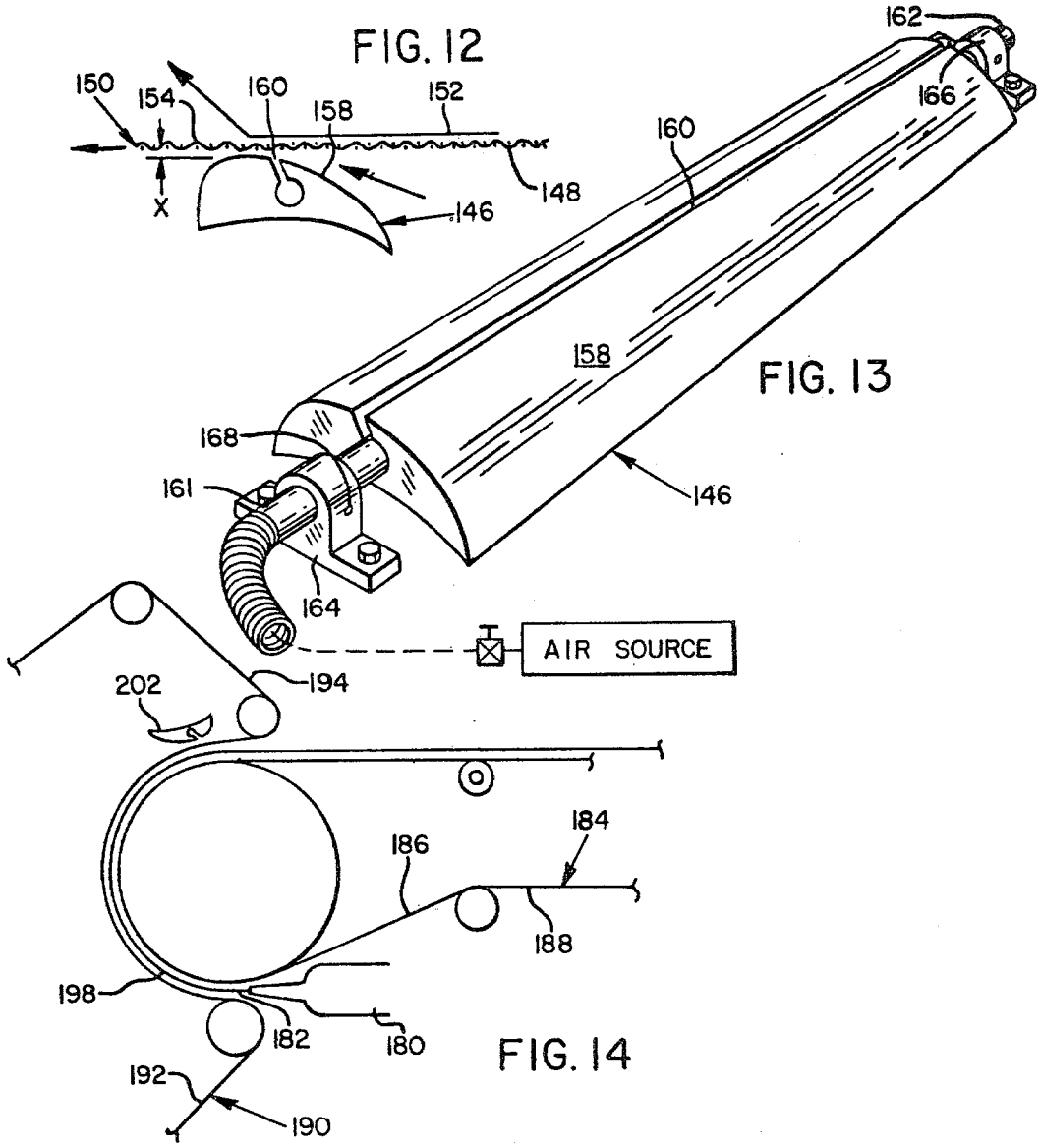
FIG. 13
FIG. 14
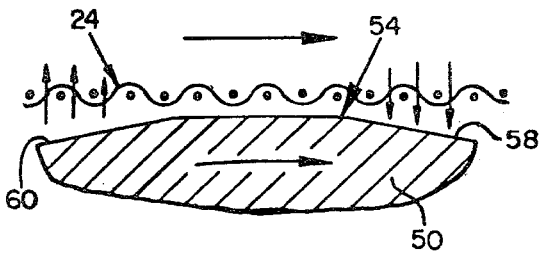
FIG. 15
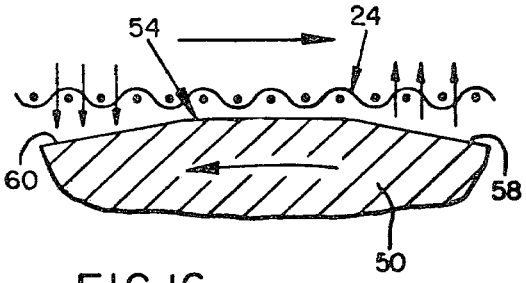
FIG. 16

METHOD AND APPARATUS FOR FORMING PAPER

This is a continuation of application Ser. No. 963,974, filed Nov. 27, 1978, now U.S. Pat. No. 4,243,482.

BACKGROUND OF THE INVENTION

The present invention relates to an apparatus and method for forming paper and a fourdrinier paper machine. More particularly, but not by way of limitation, the present invention relates to a method and apparatus for removing liquid from a web formed on a fourdrinier wire and for subsequently urging the web off of the wire.

Since its first introduction, the fourdrinier paper machine has been the most efficient apparatus for producing paper. The suitability of a modern fourdrinier machine is, however, determined by a variety of factors. The machine should operate at the highest possible speed and yet be compact in size and include the fewest possible number of moving parts. Also, it is important that the machine form a web of fibers oriented in a substantially random array so that the paper produced has the maximum possible strength. Papers having fibers in linear orientation tend to be weaker in one dimension than papers containing randomly oriented fibers.

Unfortunately, these goals tend to be mutually exclusive and have forced the paper machine designer to sacrifice one or more qualities when constructing the fourdrinier machine. Typically, the length of a machine's forming table must be increased if the machine is to operate at a high speed. This is because a high speed machine more rapidly moves the web past suction boxes and other dewatering devices. Each individual such device has less time to act on the web so the forming table must be extended in order to accomodate a greater number of such devices.

Increasing wire speed also has a detrimental effect on paper bursting strength and drying steam requirement since the percentage of fibers oriented parallel to the web increases. Such a layered web delaminates and bursts at a relatively low pressure and is insufficiently porous to facilitate rapid steam drying.

The various existing apparatuses designed for producing fiber disorientation, such as the deflector bars shown in U.S. Pat. No. 3,489,644 (Rhine), further increase the length of the fourdrinier paper machine. Similarly, U.S. Pat. No. 1,536,599 (Aldrige), No. 2,092,798 (Charlton) and No. 2,095,378 (Charlton) show devices for shaking a fourdrinier wire to disorient fibers. Such devices substantially increase the required length of the wire and do not assist in removing liquid from the web.

Recently, the speed and quality of paper formation have been enhanced by forming the web between two superposed wires of a twin-wire fourdrinier machine as is described in greater detail below. Because such twin-wire machines are very fast and do not in and of themselves solve the problem of liquid removal, they must be very long to contain a suitable number of dewatering devices. Furthermore, webs formed on such a machine are deeply settled in the wires and are thus difficult to transfer off of the wires of the forming section.

SUMMARY OF THE INVENTION

The present invention comprises an apparatus and method whch are not limited by the shortcomings of the prior art. It has been found that the table rolls and/or foils of any fourdrinier paper machine can be replaced by rolls according to the present invention which are driven at a speed other than the speed of the wire. Such rolls have a textured outer surface or are mounted in such a manner that, during rotation, they produce alternating pulses of negative and positive pressure beneath the wire to draw liquid out of the web at a location near the position where the slurry of fibers is initially deposited on the wire and to increase the percentage of fibers oriented perpendicular to the web.

As they rotate, the driven rolls simultaneously vibrate the wire to agitate the web and thus further affect the orientation of fibers located therein. By selectively choosing the rate and direction of roll rotation, the orientation of fibers can be altered to suit the desires of the papermaker.

As a result of the suction and agitation applied to the web by the rolls of the present invention, the web tends to be settled more deeply into the wire than are webs formed on ordinary fourdrinier paper machines. Because such webs are deeply settled, special measures may be required to enhance the sheet releaseability from the wire.

According to the present invention sheet release is improved by positioning a fin beneath the wire at or upstream of the location of web transfer. The fin is located a short distance below the wire and has a curved upper surface which gradually approaches the wire in the direction of wire travel. Air drawn into the area between the wire and the fin urges the web away from the wire. If necessary, additional air from a pressurized source can be directed against the web through an orifice in the fin.

It is an object of the present invention to provide a method and compact device for use with a fourdrinier paper machine to enhance the removal of liquid from a web formed on the machine and simultaneously to increase fiber randomness in the web without increasing the size or complexity of the machine.

An additional object is to provide an apparatus which can be adjusted separately to vary the strength of the web in either x, y or z directions (longitudinally, laterally or perpendicularly to the web).

Likewise, it is an object to provide an apparatus capable of forming a web with high wet strength characteristics so that wet end breaks are reduced.

Another object is to provide means for increasing the speed of a fourdrinier paper machine without increasing its size.

It is also an object to increase machine speed as aforesaid (up to one hundred percent for heavy board grades) without increasing the drying steam requirement.

A further object is to provide a device which can be retrofitted on existing fourdrinier paper machines without substantial modification thereof to improve efficiency.

An additional object is to provide means for urging a deeply settled web off of a fourdrinier wire.

Yet another object is to provide a substantially inexpensive and maintenance free system for simultaneously removing liquid from a web and for disorienting the fibers therein.

A further object is to provide a device which will improve the formation of any type paper formed on a fourdrinier paper machine of any size or type, regardless of the furnish, freeness, or consistency of the paper being formed.

A related object is to provide an apparatus with superior forming capabilities so that liner board, food board and the like can be formed from high yield pulps.

Another object is to provide an apparatus and method whereby paper drainage is adjustable and not so limited by factors such as freeness, temperature and furnish composition as heretofore.

Still another object is to provide an apparatus which will allow the papermaker to achieve greater control over "curl" in paper formed, and to reduce the "two-sidedness" of the sheet and to control cross direction stiffness.

An additional object is to provide a deliquifying device which can be used either alone or in combination with present dewatering elements such as table rolls, hydrofoils and vacuum augmented hydrofoils.

A general object is to provide an apparatus which will reduce the overall energy consumption of a fourdrinier paper machine and more specifically reduce the drying steam requirement by increasing paper porosity.

Another specific object is to provide a device which will reduce sheer forces on the fourdrinier wire and thus create less friction than prior art dewatering elements and thus reduce wear of the wire.

Accordingly, it is an object to provide an apparatus which reduces the drive requirements of the fourdrinier wire.

These and other objects and features of the invention may best be understood by reference to the following description taken in connection with the accompanying drawings.

BRIEF DESCRIPTION OF THE DRAWINGS

In the Drawings:

FIG. 1 is a partial schematic side elevational view of a fourdrinier paper machine embodying the novel structures of this invention;

FIG. 2 is a perspective view of a first embodiment of a dewatering roll according to the invention;

FIGS. *3a–3d* are enlarged partial sectional views taken along a plane perpendicular to the axis of the roll shown in FIG. 2, each showing a different roll surface texture;

FIG. 4 is a perspective view of a second embodiment of a dewatering roll according to the invention;

FIG. 5 is an enlarged front elevational view of a third embodiment of a dewatering roll according to the present invention;

FIG. 6 is an enlarged partial sectional view taken along line 6—6 of FIG. 5;

FIG. 7 is an enlarged partial view of the surface of the dewatering roll shown in FIG. 5;

FIG. 8 is an enlarged schematic side elevational view of a fourth embodiment of a dewatering roll according to the present invention;

FIG. 9 is a partial schematic side elevational view of a fourdrinier paper machine having a twin-wire forming section embodying dewatering rolls according to the present invention;

FIG. 10 is a partial schematic side elevational view of a fourdrinier paper machine having a vertical twin-wire forming section embodying dewatering rolls according to the present invention;

FIG. 11 is a schematic diagram of a control and drive mechanism for use with a dewatering roll according to the present invention;

FIG. 12 is an enlarged schematic side elevational view of fin apparatus according to the present invention;

FIG. 13 is a perspective view of the fin apparatus shown in FIG. 12;

FIG. 14 is a partial schematic side elevational view of a fourdrinier paper machine having a twin-wire forming section embodying the fin apparatus shown in FIG. 12; and FIGS. 15 and 16 are enlarged partial sectional schematic views taken along a plane perpendicular to the axis of a roll shown in FIG. 1.

DESCRIPTION OF PREFERRED EMBODIMENTS

The present invention includes two elements which have separate utility, but which, when incorporated together in a fourdrinier paper machine, comprise a complete system to convert an otherwise standard paper making machine for high speed operation and the production of paper with improved formation characteristics, without adding to the length of the machine.

The first of these elements is the unique dewatering roll apparatus which replaces one or more of the table rolls or foils of a standard fourdrinier wet end. This apparatus rapidly draws water from the web, as it is formed, and can be used to control the degree and direction of fiber orientation in the web.

The second element is a fin apparatus located between the location where the orientation of fibers in the web becomes fixed and the location where the web is transferred off of the wire. The fin provides a wave of elevated pressure to urge the web away from the wire so that it can be transferred without difficulty.

FIG. 1 illustrates the two element system used in the wet end of a conventional fourdrinier paper machine. The machine includes a head box 20 which deposits a stock 22, comprising a suspension of fibers, onto the outer surface of a moving foraminous base conveyor of fourdrinier wire 24. The conveyor has an outer surface 26 which receives the stock and an inner surface 28 which faces breast and couch rolls 30, 32 and other machine elements which support the portion of the wire on which paper is formed. The wire 24 is also supported by a wire turning roll 34 located downstream of the couch roll 32. Return rolls 36 are provided to maintain the wire 24 at a suitable tension.

In the machine of FIG. 1, the wire 24 travels clockwise so that the stock 22 is carried to the right over a plurality of dewatering devices which draw liquid out of the stock and convert it into a continuous fibrous web 38. The web transfers off the wire 24 at a transfer point located between transfer rolls 40, 43 and is received by a subsequent section of the machine.

The machine may include a variety of dewatering devices such as conventional table rolls 42 and conventional suction boxes 44. In preferred embodiment of the present invention, these conventional devices preferably are located downstream of the area, immediately adjacent the headbox 20, where the web is formed.

DEWATERING ROLL APPARATUS

In accordance with the present invention, a fourdrinier paper machine is provided with a special dewatering roll apparatus which preferably is located beneath the wire at the paper formation area immediately downstream of the machine's headbox. The dewatering roll apparatus includes one or more special dewatering rolls 50, six of which are inclined in the machine shown in FIG. 1.

These rolls 50 are rotatably supported on the inner surface 28 of the conveyor 24. Each roll 50 has an outer surface which, when the roll is rotated, periodically displaces the conveyor in a vertical direction and create pulses of negative pressure between the roll 50 and the conveyor 24. Drive means are provided for rotating the rolls 50 so that the speed of the outermost portion of the outer surfaces of the roll does not equal the speed of the conveyor. To further enhance the dewatering ability of the rolls 50, each such roll is enclosed in a suction box 52 which has an upper surface facing the conveyor and which includes a slot through which an upper portion of the roll extends as shown in FIG. 1. A conduit 53 connects one or more of the boxes 52 to a vacuum pump or similar device (not shown) to create a negative pressure inside the box.

As FIGS. 2–8 illustrate, dewatering rolls according to the present invention can have a variety of different surface configurations. For example, the roll shown in FIG. 2 has a generally cylindrical outer surface comprised of multiple raised portions or ridges 54. The ridges alternate with channels or troughs 56. Such alternating ridges and channels extend parallel to one another and to the axis of rotation.

Most preferably, the ridges are spaced at equal intervals of three eighths to three quarters of an inch around the roll 50 and are one eighth to one quarter inch in both height and width. It would normally be expected that the size and spacing of such ridges would be an inverse function of the intended speed of roll rotation since at high speeds, large and widely spaced ridges could create so much agitation that stock would be thrown off the conveyor. The ridges should be at least as long as the width of the web 38. As described below, rotation of a roll 50 results in the formation of a cushion of liquid between the roll and the wire and periodically displaces the entire width of the conveyor 24 in a direction perpendicular to the roll's axis of rotation so that a seal between the outermost portion of the ridges of roll 50 and the conveyor 24 is formed by the cushion of liquid created therebetween.

The enlarged views of FIGS. 3*a* and 3*b* illustrate specific advantageous transverse configurations for the ridges 54 and troughs 56. FIG. 3*a* shows two opposed substantially flat outer side walls 58*a*, 60*a* which taper inwardly from the outer surface at the ridges 54*a* of a roll 50*a* to define channels 56*a* which are substantially "V" shaped in cross section. Similarly, the channels 56*b* of the roll 50*b* shown in FIG. 3*b* are defined by tapering side walls 58*b*, 60*b*. The channels of FIG. 3*b* also include a floor 62*b* which is substantially concentric to the circumference of the outer surface of the ridges 54*b*. Also, each channel 56*b* is bounded by two opposed inner side walls 64*b*, 66*b* which extend substantially radially between the outer side walls 58*b*, 60*b* and the floor 62*b*. In any instance where the dewatering roll includes channels having substantially flat outer side walls of the type shown in FIGS. 3*a* and 3*b*, it is preferred that each outer side wall extends at an angle $\theta$ (FIG. 3*a*) of between one and ten degrees to a plane P tangent to the outer surface of the ridge at the location where the outer wall and surface meet.

It is important that adjacent sidewalls of such rolls do not meet to form an edge. Instead, a circumferential area of the outermost roll surface should extend between adjacent sidewalls as illustrated. A seal is formed by the cushion of liquid situated between the conveyor and this area of the roll as described below so that pulses of negative pressure can be induced by roll rotation. A knife-like edge would not form as good a seal and would likely cause rapid wear of both the conveyor fabric and the roll surface.

FIG. 3*c* shows an alternative embodiment in which ridges 54*c* and channels 56*c* together comprise a smooth, curved surface of substantially sinusoidal corrugations. FIG. 3*d* illustrates a composite surface which includes channels 56*d* defined alternately by flat and curved sidewalls. The curvature of channels in these two views is slightly exaggerated for illustrative purposes only.

Although it is preferred that the ridges and channels be straight and parallel to the roll axis, especially favorable results may sometimes be obtained using rolls 70 having channels 56 and ridges 54 which are helical, such as those illustrated in FIG. 4. The helix angle of the ridges could be any angle between slightly greater than zero degrees and ninety degrees. An angle of between eighty and eighty-five degrees is preferred since lower helix angles could unduly interfere with machine runability.

Unlike other preferred rolls which have no effect on the lateral alignment of the conveyor 24, a helically corrugated roll can urge the conveyor fabric to move laterally. Helically corrugated rolls should thus be used in pairs with the two rolls being mounted serially. If both rolls of a pair have ridges of the same hand, they should be rotated in opposite directions so that the lateral forces exerted by the rolls cancel each other out. Alternatively, if the two helically corrugated rolls are of different hand, e.g. one of the two rolls is a mirror image of the other, the rolls can be driven in the same direction.

A third alternative embodiment of the dewatering roll apparatus is a roll having multiple indentations spaced around the roll in a uniform pattern. Such a roll 74 is shown in FIGS. 5–7 as having indentations 76 arranged in a checkerboard pattern to define axial, circumferential and helical rows A,C,H. The axially extending rows are evenly spaced around the roll and are at least as long as the width of the web so that rotation of the roll periodically creates pulses of negative pressure between the roll and the conveyor at the location of the indentations. Axially extending areas of the roll outer surface, between the axial rows of indentations, create positive pressure pulses which displace the entire width of the conveyor in a direction perpendicular to the roll and agitate fibers in the web.

FIG. 8 illustrates a fourth alternative dewatering roll apparatus. The roll 80 shown in FIG. 8 has a cylindrical outer surface 82, but is mounted off center by a dimension D so that the roll's surface 82 moves eccentrically when the roll 80 is rotated. The surface 82 thus alternately approaches and retreats from the conveyor 24 as the roll rotates.

To prevent machine vibrations which otherwise would be induced by its eccentric mounting, the roll 80 should be carefully balanced so that the axis of rotation extends through the roll's center of gravity. To provide an enhanced dewatering effect, the roll 80 must be rotated so that the speed of the roll surface is substantially different than the speed of the conveyor. The dimension D need only be a few thousandths of an inch.

Surfaces for rolls of the type described can be made of any material which provides a good bearing surface. Silicon carbide, ceramics, polyethylene, hard rubber and stainless steel are examples of materials which would be suitable. The rolls are preferably eight to sixteen inches in diameter.

FIGS. 9 and 10 illustrate how dewatering rolls according to the present invention can be advantageously used with high speed fourdrinier paper machines having twin-wire forming sections. Such twin-wire formers have been developed recently to produce papers having less two-sidedness, less wire mark and to better control the forming of the paper. In general, such machines have made it possible for paper mills to manufacture high quality paper at higher speeds than was previously possible.

The apparatus shown in FIG. 9 is such a twin-wire former. It is of the type manufactured by the Valmet Company of Finland under the trademark "Synformer". This machine is very similar to the apparatus shown in FIG. 1 so many of the common parts are numbered identically in both figures. In addition to the features shown in FIG. 1, the apparatus of FIG. 9 includes a second or facing conveyor 86 which has opposed inner and outer surfaces 88, 90. A portion of the facing conveyor is superposed on the base conveyor 24 with the outer surfaces 26, 88 of the conveyors 24, 86 facing one another so that at least a portion of the web formation process occurs between the two conveyors.

To facilitate formation of the web 38 between the conveyors 24, 86, liquid can be removed simultaneously from both sides of the web by dewatering rolls 94 according to the present invention of the type previously described. These rolls are located in opposed relationship to the inner surfaces 28, 90 of the two conveyors.

To prevent dewatering rolls on opposite sides of the web from off-setting the effect of one another and to prevent excess wear on the conveyor, the rolls 94 are located so that none of the rolls opposing the base conveyor 24 is directly opposite a roll opposing the facing conveyor 86. Ideally, the rolls opposing the base conveyor 24 are staggered in relation to rolls opposing the facing conveyor 86 as are the rolls shown in FIG. 9. The rolls 94 are contained in special suction boxes 96 similar to the boxes 52 which were previously described. Conduits 98 link these suction boxes to a source of negative pressure.

FIG. 10 illustrates another application of dewatering rolls according to the present invention in a twin-wire forming section. The illustrated apparatus is a "Vertiforma" machine manufactured by the Black Clawson Co. of New York, New York. In this apparatus, a nozzle headbox 102 injects a stream of stock 104 into the ingoing nip formed between converging base and facing conveyors 108, 110. A web 112 is formed as it moves downwardly between two conveyors 108, 110. As the stock moves downwardly, liquid is withdrawn through both of the conveyors by a means of staggered dewatering rolls 116 contained in special suction boxes 118.

DEWATERING ROLL OPERATION

Because of their construction, dewatering rolls according to the present invention serve a variety of functions. Specifically, they accelerate dewatering, can be used to adjust sheet strength and other formation characteristics, and can reduce overall energy consumption. This is done by driving the rolls to vibrate the wire and alternately subject the wire to pulses of positive and negative pressure.

FIGS. 15 and 16 are illustrative of how these actions are accomplished. Both these Figures show an enlarged portion of a roll of the type shown in FIG. *3a* or *3b*.

FIG. 15 illustrates the effect of a roll 50 rotated so that the peripheral roll surface moves in the same general direction as the wire, but at a greater speed. As the roll rotates, the wire 24 is periodically acted on by the various portions of the roll surface. As any of the portions approach the wire 24, they are converging with the wire thereby creating upwardly directed pulses of positive pressure immediately upstream of the roll 50 as shown by arrows above the surface 60. Immediately downstream of the roll, the various roll surface portions create pulses of negative pressure to draw liquid from the web as illustrated by arrows above the sidewall 58. Water thus removed collects in the troughs between the ridges and is carried by the roll until it is thrown off the roll or falls off by gravity.

Not all these pressure pulses are of equal strength, because each of the different portions of the roll surface are at a different angle relative to the wire 24. For example, as a leading side wall 58 begins to move away from the wire, a strong pulse of negative pressure is created between the wire 24 and roll 50. As the trailing sidewall 60 passes beneath the wire, water trapped between the wall 60 and wire 24 are compressed into a progressively smaller volume so that water is forced upwardly into the wire as shown by arrows above the wall 60. This strong pulse of positive pressure reorients fibers in the web perpendicular to the wire and lifts the wire up away from the roll. As the outermost portion of ridge 54 passes beneath the wire, water between the roll and wire maintains the wire 24 at a distance from the ridge top and forms a seal between the ridge and the wire 24.

The net result of the roll rotation illustrated in FIG. 15 is that the wire is maintained on a cushion of liquid as it passes over the roll. A large portion of water is pulled from the web and collected in the troughs between the ridges. Most of this water is carried to the downstream side of the roll, where it is collected and piped away from the paper machine. But, a fraction of the water is reintroduced into the web by the trailing sidewall 60 to increase the percentage of fibers in perpendicular orientation and thereby increase porocity and two-direction strength. The general vibration of the wire 24 caused by rotation of the roll 50, tends to randomize fibers and thus equalize strength in all directions.

As previously described, dewatering is further enhanced if the roll is contained in a suction box which creates a certain amount of negative pressure on both sides of the roll. Despite the increased suction and dewatering provided by the suction box, wire friction remains low because the wire is maintained on a liquid cushion above the rotating roll, which extends out of the box. This is unlike prior art suction boxes which increase wire friction by pulling the wire against the box.

FIG. 16 shows a roll 50 driven so that its peripheral surface moves in the opposite direction from the wire 24. This arrangement produces similar results to that of FIG. 15, but in a different manner.

By driving the roll 50 counter to the wire 24 liquid pulled from the web collects on the upstream side of the roll 50. Also, the functions of the sidewalls 58, 60 are exchanged. When rotation is reversed, the sidewall 60 is the leading sidewall which creates the strong negative pressure pulse; and the sidewall 58 is the trailing sidewall which creates the strong positive pulse.

When the roll is driven as shown in FIG. 16, the difference between relative speeds of roll and wire will be much greater than if the roll is operated at the same speed, but in the direction of the roll as shown in FIG. 15. Operation as shown in FIG. 16 can thus be used to maximize wire vibration and fiber agitation at a given roll speed. To minimize agitation, for the purpose of retaining fines during the production of fine grade papers, the roll can be rotated as shown in FIG. 15, but at a peripheral speed slower than that of the wire.

It will be apparent to one skilled in the art that the speed and direction of roll rotation has a substantial effect on sheet formation and that a degree of experimentation may be necessary to select optimum operating conditions to achieve a desired result.

The difference among roll surfaces, discussed above in conjunction with FIGS. 3–8, will also affect the manner in which the sheet is formed. Each style, however, is adapted to produce positive and negative pressure waves to vibrate the wire and to provide a cushion of liquid on which the wire rides to reduce friction.

An important consideration to the successful operation of the present invention is the manner in which the rolls are driven in relation to each other and to the wire. One or multiple rolls can be used, but in any event, the rolls should be driven independently of the conveyor so that the outermost surface of each dewatering roll travels at a speed different than the speed of the conveyor. The rolls would be effective dewatering devices if rotated at the speed of the conveyor, but would not be substantially more effective than standard table rolls. Furthermore, to achieve the other advantages associated with rolls according to the present invention, it would be necessary to use multiple synchronous rolls when operating at the same speed as the wire.

In most instances, it is thus necessary that the dewatering rolls of the present invention be driven independently of the conveyor so that they may be operated at a different speed. Independently controlled drive means are also advantageous because the machine operator can adjust the roll/wire speed ratio to any desired value.

Although the dewatering rolls according to the present invention can operate at any speed different than the conveyor speed, optimal operation will sometimes require that the speed of a dewatering roll be maintained at a fixed ratio to the speed of the conveyor. Since the conveyor speed will vary depending on conditions affecting the machine, the quality of the stock and other factors, means should be provided for automatically varying the speed of dewatering roll rotation proportionally as the speed of the conveyor is changed.

Such automatic adjustments could be accomplished by a simple mechanical linkage speed control. More preferably, the rate of roll rotation will be determined by a system of the type shown in FIG. 11 which provides adjustable controls which the paper machine operator can use to adjust the ratio of roll to conveyor speed as desired to achieve different degrees of water removal or other desired effects.

In FIG. 11 the fourdrinier wire is illustrated schematically as a block 124. The speed of the wire 124 is detected by an appropriate speed measuring device 126 such as a tachometer connected to a roll moving at the speed of the wire 124. The speed sensor 126 given an output signal 128 to an adjustable motor speed control device 130 which controls the speed of a motor 132 connected to one or more dewatering rolls 134.

Preferably, a feedback system will be provided for precise control of the roll 134. This system would include a speed sensing device 138, such as a techometer connected to the roll 134, for transmitting an output signal 140 concerning the speed of the roll 134 to the speed control 130.

The speed control 130 will be adapted to maintain the speed of the driven roll in a fixed ratio with the speed of the fourdrinier wire 124. Thus, when the wire 124 changes speed and the speed sensor 126 transmits an appropriate output signal, the motor speed control 130 will respond by proportionally changing the speed at which the motor 132 is operated. Preferably, the speed control 130 will include operator adjustable controls so that the paper machine operator can select a desired ratio of roll to wire speed.

Motor controls suitable to provide the above control functions are readily available from a variety of sources and are commonly in use on modern paper making machines. Reliance Electric Company of Cleveland, Ohio and General Electric Company of Schenectady, New York supply such systems of paper making machine controls. Similar controls are common in steel rolling mills. The most elaborate of such motor control systems incorporate electronic processors to make appropriate speed comparisons and motor control commands.

By providing a speed control mechanism which may be adjusted to alter the roll/wire speed ratio, it is possible for the machine operator to control various aspects of the paper formation. For example, if the motor controls are set so that the dewatering rolls are driven at a positive speed, i.e. the wire and roll surface travel in the same general direction at their location of contract, the tensile strength of paper formed will be high in the direction of web movement. When, however, dewatering rolls are driven at a negative speed, i.e. the wire and the roll surface move in opposite directions at their location of closest spacing, the lateral or cross web direction tensile strength of the web is increased thereby making the sheet more even in strength in all dimensions.

Ability to adjust the absolute speed of roll rotation is important because the rate of water removal is effected by the rotation speed. And, perhaps more importantly, motor speed adjustment can be used to tune the driven dewatering rolls to minimize barring of the web. When a web is formed over a textured or an eccentric roll, there is a tendency for the web to form unevenly because bar marks are created whenever an elevated portion of the roll lifts the wire. This problem is especially pronounced in instances where the roll's outer surface speed is identical to the speed of the wire. Even when the speeds of the roll and wire are different, as taught by the present invention, barring can remain a problem because different portions of the web are subjected to different amounts of positive or negative pressure applied by the driven dewatering roll.

By constructing the rolls as previously described so that they provide pulses of pressure at fixed regular intervals, it is possible to virtually eliminate all bar marking by operating at a selected speed ratio which will cause the pulses of the positive and negative pressure produced by the rotating roll to be distributed so that all portions of the web will receive substantially the same amount of positive and negative pressure exerted by the rotating dewatering rolls.

There are theoretical, mathematical relationships which can be derived to determine optimum ratios of roll to wire speed based upon the distance between the ridges of the roll's surface and the speed of both the wire and the roll. More specifically, barring is reduced if the roll is driven at a speed such that positive and negative pressure pulses partially overlap. The pulses of negative pressure thus remove water from the web while intervening pulses of positive pressure act to restore the web to a more uniform texture. The optimum speed of a dewatering roll and favorable roll/wire speed ratios can be selected by empirical testing.

Some very satisfactory results are obtained when a roll is rotated at a natural multiple or fraction of the wire speed. Specifically, it is desirable in some instances to rotate the roll at a speed such that the outermost portion of the roll's surface moves at a speed equal to the speed of the conveyor multiplied by a number which is an integer (other than zero or positive one) or a number which is a reciprocal of one such integer. It thus increases convenience to provide adjustable motor controls capable of maintaining the roll at such a speed ratio as selected by the machine operator.

Adjustable speed controls are especially beneficial when multiple rolls are included in a dewatering system. If, for example, the dewatering system includes multiple sequential rolls which are identical to one another, the speed controls can be adjusted so that the rolls operate synchroneously. When properly synchronized, the rolls collectively produce pulses of negative pressure which are evenly distributed along the inner surface of the wire and in sufficiently close proximity that all portions of the web are subjected to a substantially uniform amount of negative pressure. This arrangement can avoid barring when operating in a very large range of roll/wire speed ratios.

It is possible to intermix different styles and sizes of dewatering rolls and to operate them at different speeds in order to minimize barring or for some other purposes. Since, however, the relationship of wire and roll speeds may need to be carefully regulated to obtain desirable results such mixed systems should include motor speed control means which can separately adjust the speed and direction of roll rotation for each individual roll.

The operable range of roll/wire speed ratios is determined by a number of factors including the spacing of the ridges on the rolls and the size and number of dewatering rolls included in the system. A most significant factor will be the absolute speed at which the conveyor is intended to run. If, for example an older model paper machine designed to operate at about 100 feet per minute were retrofitted with a dewatering roll according to the present invention, the roll could be operated at a positive or negative surface speed of up to 60 times the speed of the conveyor. A pulp or food board machine that operates at a wire speed of 200 feet per minute could accomodate a roll operating at up to about 30 times the positive or negative speed of a conveyor. By contrast, a modern newsprint machine operating at 3500 feet per minute might have a maximum positive or negative roll speed of 4 times the conveyor speed; and for a tissue machine operating at 5500 feet per minute, the maximum acceptable ratio of roll surface speed, in either direction, to conveyor speed would be about two to one.

FIN APPARATUS

One potential difficulty which arises when a dewatering roll apparatus according to the present invention is used to accelerate the removal of liquid from a web is that the web tends to be drawn more deeply into the fabric so that sheet release can become a problem. In other words, there is increased chance that the web will tear at the location where it is transferred off of the conveyor by the draw of a subsequent machine section. The normal solution would be to reduce wire speed, but that would partially defeat the purpose of using the improved dewatering rolls of the present invention.

Similar sheet release problems occur in modern twin-wire forming sections because a web formed between two conveyors tends to be more deeply imbedded than a web formed on a single wire. When the base and facing conveyors, of a twin-wire former diverge, there is a tendency for the paper to be pulled apart. Further sheet release problems develop downstream where the web is transferred off the base conveyor to a subsequent machine section.

All of these sheet release difficulties may be substantially reduced by a fin apparatus located beneath the conveyor for urging the web off of the wire. As shown in FIG. 12, a fin 146 of uniform transverse cross section is supported beneath the inner surface 148 of a moving conveyor 150 which supports a web 152 on its outer surface 154. The fin 146 extends across the conveyor 150 and has a convex upper surface 158 which ascends gradually toward the inner surface 148 of the conveyor 150.

For most efficient operation, the fin will include an orifice 160 which opens toward the conveyor and is connected by a pipe 161 to a source of pressurized air so that a stream of air can be directed outwardly through the orifice 160 toward the inner surface 148 of the conveyor 150 to assist in urging the web off of the wire.

The most preferred fin apparatus has a transverse cross section which comprises a smooth convex surface that diminishes in radius toward the downstream end of the fin. The fin is mounted so that its outer surface 158 is tangential to a plane parallel to the conveyor 150 with the fin 146 located a short distance X away from the conveyor. The distance X, preferably one sixteenth to one eighth of an inch, is established to provide a small gap between the fin and the conveyor for the passage of liquids therebetween. The fin surface 158 approaches the wire gradually so that most of the liquid carried by the wire will flow through the gap and not be deflected upwardly into the web. This is important because a web which is too wet at this location will not readily transfer off of the wire.

The fin should be adjustably mounted so that it may be raised, lowered or tilted in relation to the conveyor. When the fin has a diminishing cross section as previously described, this can be readily accomplished by extending the pipe 161 outwardly of the end of the fin and locating a second pipe 162 at the opposite end of the fin in axial alignment with the pipe 161. The pipes 161, 162 are mounted in bearing blocks 164, 166 and held in place by means of a set screw 168. With this arrangement the distance X can be varied by loosening the set screw 168 and rotating the pipes 161, 162 in the bearing blocks 164, 166 so that the surface 158 of the fin 146 is moved relative to the conveyor 150. The pipe 162 serves as a drain line for any liquid from the web which enters the interior cavity of the fin through the orifice 160.

FIN OPERATION

A fin apparatus of the present invention assists in the separation of a web from a conveyor by creating a wave of positive pressure on the inner surface of the conveyor. As the conveyor moves (toward the left in FIG. 12), air moving beneath the conveyor is funnelled by the upstream fin surface into the narrow space between the fin and the conveyor. Because the air is funnelled through a narrow gap, gas pressure is elevated in the region between the conveyor and the upper surface of the fin and pushes against the surface of the web which faces the conveyor thereby urging it off.

Accordingly, it is appropriate that the fin be located at a position at or shortly upstream of the location where the web is to be transferred off of the outer surface of the conveyor. As shown in FIG. 1, a fin 174 can be located just at the position of web transfer. It would also be appropriate to locate a fin 176 further upstream, but any such fin apparatus should be located downstream of the location where the orientation of fibers in the web becomes fixed, preferably downstream of all dewatering devices in the forming section. The fins do not provide enough pressure to completely separate the web from the conveyor so it is not essential that a fin be located exactly at the location of transfer.

If one fin provides insufficient lift, two may be used together as shown in FIG. 1. The effect of individual fin operation can be adjusted somewhat by varying the flow rate of air being discharged through the orifice 160 and the distance between the fin and the wire.

As previously mentioned, a fin according to the present invention can advantageously be used in a twin-wire former at the location of wire divergence. This is illustrated in FIG. 14 which shows a tissue machine in which a nozzle type headbox 180 injects a stream of stock 182 between a base conveyor 184 having inner and outer surfaces 186, 188 and a facing conveyor 190 having inner and outer surfaces 192, 194.

A web 198 is formed between the outer surfaces 188, 194 of the superposed conveyors and is subsequently transferred off of the facing conveyor's outer surface 194 where the two conveyors diverge. A fin 202 according to the present invention can advantageously be located adjacent the inner surface 192 of the facing conveyor 190 near the location where the conveyors begin to diverge. The fin 202 extends across the width of a facing conveyor 190 so that the fin's convex surface gradually approaches the inner surface 192 in the direction of conveyor travel. When the conveyors are moving, gas pressure is elevated between the facing conveyor 190 and the fin 202 to urge the web 198 off of the facing conveyor 192 and onto the base conveyor 184. If additional assistance is required in transferring the web from the base conveyor 184 to a subsequent section of the machine, a second fin (not shown) may be mounted adjacent the inner surface 186 of base conveyor 184 in the same manner that the fins 174, 176 shown in FIG. 1 are mounted adjacent the inner surface 28 of the conveyor 24.

While I have shown and described several embodiments of my invention, it will be apparent to those skilled in the art that many other changes and modifications may be made without departing from my invention in its broader aspects. I therefore intend the appended claims to cover all such changes and modifications as fall within the true spirit and scope of my invention.

I claim:

1. In an apparatus for forming a continuous fibrous web from an aqueous suspension of fibers deposited on the outer surface of a moving foraminous base conveyor having opposed inner and outer surfaces:

a substantially cylindrical roll having an outer surface defining alternating raised and channel portions parallely extending over said outer roll surface in a generally axial direction, said roll being mounted contiguous to the inner surface of said conveyor and extending thereacross transversely of the direction of conveyor travel but spaced therefrom an amount such that during operation of said apparatus a cushion of liquid removed from said fiber suspension is interposed between the inner surface of said conveyor and the outer surface of said roll so that during such operation said conveyor inner surface is spaced from said roll outer surface and is supported by said cushion of liquid; and drive means for rotating said roll so that the speed of the outermost portion of said outer surface of said roll does not equal the speed of said conveyor so that as a roll raised portion passed through a location closest to the inner surface of said conveyor, areas of oppositely directed pressure pulses are applied to the conveyor inner surface immediately upstream and downstream from said location respectively, so that at least some liquid is removed from said fiber suspension in the area of a negative pressure pulse to form said liquid cushion whereupon the liquid is carried on said roll surface and a portion thereof reintroduced into the fiber suspension in the area of a positive pressure pulse at high velocity to agitate said suspension and orient a portion of the fibers thereof in a direction substantially perpendicular to the direction of travel of said conveyor.

2. Apparatus as recited in claim 1 further including suction means for impressing a negative pressure on the inner surface of said conveyor in the regions adjacent to the area on which the conveyor is maintained on said liquid cushion.

3. Apparatus as recited in claim 2 wherein said suction means includes a suction box surrounding said roll, said box having an upper surface which faces the inner surface of said conveyor in which a slot is formed through which an upper portion of said roll extends, and means for creating a negative pressure inside said box whereby said negative pressure is impressed on said conveyor inner surface through spaces defined between said slot and said roll portion extending therethrough.

4. The apparatus of claim 2 comprising a plurality of said rolls spaced at intervals contiguous to said inner surface of said conveyor and extending thereacross transversely of the direction of conveyor travel.

5. The apparatus of claim 4 wherein:

said rolls are substantially identical; and said drive means includes means for driving all said rolls so that the outermost surface portions of said rolls move at a common speed.

6. The apparatus of claim 5 wherein said drive means further comprises means for synchronously rotating said rolls in such a manner that said pulses of negative pressure, collectively produced by said rolls, are evenly distributed along said inner surface of said conveyor in sufficiently close proximity to one another that all portions of said fiber suspension are substantially uniformly acted upon by said rolls.

7. The apparatus of claim 1 further including a moving foraminous facing conveyor having opposed inner and outer surfaces, said facing conveyor being located in opposed relationship to said base conveyor with the outer surfaces of said conveyors facing one another so that said web is formed between said conveyors; and a plurality of said rolls spaced at intervals and contiguous to the inner surface of said facing conveyor.

8. The apparatus of claim 7 wherein:

said rolls are located so that none of said rolls contiguous with said base conveyor is located directly opposite any of said rolls contiguous with said facing conveyor.

9. The apparatus of claim 8 wherein said rolls contiguous with said base conveyor are staggered in relation to said rolls contiguous with said facing conveyor.

10. The apparatus of claim 1 wherein said channel portions are defined by two substantially flat opposed side walls which extend toward each other in the inward direction.

11. The apparatus of claim 10 wherein each of said side walls extends at an angle to a plane tangent to the outer roll surface at the line where said wall and said surface join, said angle being in the range of between about one and ten degrees.

12. The apparatus of claim 10 wherein said opposed side walls terminate at their outer ends to define said raised portion between them, said raised portion including a surface extending substantially circumferentially relative to said roll between said opposed side walls.

13. The apparatus of claim 1 further comprising a fin of uniform transverse cross-section supported beneath said conveyor at a location downstream of said roll to facilitate the transfer of said web from said conveyor, said fin extending across said conveyor and having a convex upper surface which ascends toward the inner surface of said conveyor in the direction of conveyor travel whereby when said conveyor is moving, gas pressure is elevated between said conveyor and said upper surface at the upstream end thereof to urge said web off of said conveyor.

14. A process for forming a continuous fibrous web from an aqueous suspension of fibers deposited on the outer surface of a moving foraminous conveyor having opposed inner and outer surfaces comprising the steps of:

rotatably mounting a substantially cylindrical roll having an outer surface defining generally axially extending alternating raised and channel portions contiguous to the inner surface of said conveyor so that it extends transversely thereacross in the direction of conveyor travel;

applying oppositely directed pressure pulses to the inner surface of said conveyor at areas immediately upstream and downstream from a particular location, respectively, by rotating said roll while said suspension carrying conveyor is being moved at a rate such that the speed of the outermost portion of the outer surface of said roll does not equal the speed of the conveyor whereupon at least some liquid is removed from the suspension in the area of a negative pressure pulse to form a liquid cushion interposed between said roll and said conveyor inner surface to support the latter and so that the roll outer surface is spaced from said conveyor inner surface of said cushion of liquid and whereupon at least some liquid is reintroduced from the liquid cushion into the suspension in the area of said positive pressure pulses at high velocity to agitate said suspension and orient a portion of the fibers thereof in a direction substantially perpendicular to the direction of travel of said conveyor.

15. The method of claim 14 including the further step of impressing a negative pressure on the inner surface of said conveyor in the regions adjacent to the area on which the conveyor is maintained on said liquid cushion.

16. The method of claim 14 further comprising at a position immediately upstream of a location where said web is to be trasnferred from said outer surface of said foraminous conveyor, the step of gradually constricting the pathway of air moving along said inner surface of said conveyor so that an elevated pressure is applied to said inner surface to urge said web off said conveyor.

* * * * *